US008636108B2

(12) United States Patent
Foster, Sr. et al.

(10) Patent No.: US 8,636,108 B2
(45) Date of Patent: Jan. 28, 2014

(54) STEEP ROOF ASSIST

(76) Inventors: Odes Foster, Sr., Houston, TX (US); Odes Foster, Jr., Houston, TX (US)

( * ) Notice: Subject to any disclaimer, the term of this patent is extended or adjusted under 35 U.S.C. 154(b) by 176 days.

(21) Appl. No.: 12/911,730

(22) Filed: Oct. 26, 2010

(65) Prior Publication Data

US 2011/0314769 A1 Dec. 29, 2011

Related U.S. Application Data

(60) Provisional application No. 61/398,464, filed on Jun. 25, 2010.

(51) Int. Cl.
*E04G 1/36* (2006.01)

(52) U.S. Cl.
USPC ..... 182/45

(58) Field of Classification Search
USPC ..... 182/45, 206, 108, 129; 248/237; 52/652.1
See application file for complete search history.

(56) References Cited

U.S. PATENT DOCUMENTS 232,556 A * 9/1880 Silvius ..... 182/45
3,447,631 A * 6/1969 Smith ..... 182/108
4,531,613 A * 7/1985 Keigher ..... 182/206
6,167,987 B1 * 1/2001 Jensen ..... 182/45
2011/0315478 A1 12/2011 Foster, Sr. et al.

OTHER PUBLICATIONS

Filing receipt and application entitled "Steep Roof Assist," by Odes Foster Jr., et al., filed Jun. 25, 2010 as U.S. Appl. No. 61/398,464.

* cited by examiner

*Primary Examiner* — James O Hansen
*Assistant Examiner* — Kristine Florio
(74) *Attorney, Agent, or Firm* — Conley Rose, P.C.; Rodney B. Carroll; Keith C. Rawlins

(57) ABSTRACT

Apparatus and methods are disclosed. An apparatus is used over a ridge of a steep-pitched roof and an embodiment thereof has a first portion, a first shoe interconnected to the first portion, a second portion, a second shoe interconnected to the second portion, a first leg support connected to the first portion and to the first shoe, a second leg support connected to the second portion and to the second shoe. The first portion is positioned at an angle relative to the second portion so as to approximate the angle of the ridge of the steep-pitched roof. The first and second portions have a telescoping mechanism positioned thereon. A method includes placing the first shoe on a first surface of a roof, placing the second shoe on a second surface of a roof, and tying-off to an anchor member of the apparatus.

19 Claims, 4 Drawing Sheets

STEEP ROOF ASSIST

REFERENCE TO RELATED APPLICATIONS

This application claims the benefit of, and incorporates by reference, U.S. Provisional Application No. 61/398,464, filed on Jun. 25, 2010.

TECHNICAL FIELD

The disclosure relates to roofs having a steep pitch. Particularly, the disclosure relates to horizontally and vertically traversing steep-pitched roofs. Additionally, the disclosure relates to equipment for anchoring persons while on a steep-pitched roof.

BACKGROUND

Roofs can be constructed with surfaces thereof having a steep pitch, and various roof workers must traverse the steep-pitched roofs. Roof workers include but are not limited to: satellite-dish installers, home-owners, chimney workers, telecommunications personnel, and electricians.

By way of example, to install a satellite dish, a roof worker typically climbs a traditional ladder in order to access the roof. The roof worker then traverses vertically on the roof to determine a height for the dish, traverses horizontally on the roof to determine a lateral position for the satellite dish, and places the satellite dish at the determined height and lateral position on the roof. The height and lateral position of the satellite dish are determined as the optimal place on the roof for the satellite dish to receive satellite signals. Thus, roof workers traverse both horizontally and vertically on steep-pitched roofs in order to install satellite equipment.

When a roof worker horizontally and vertically traverses a steep-pitched roof, a variety of problems can arise. First, footing is unstable. Continuing with the example above, unstable footing leads to less efficient satellite-dish installations because roof workers dedicate time and energy to maintaining a firm footing in addition to installing equipment. The loss of time and energy is not recoverable and is a built-in cost of doing business for companies employing roof workers. Second, persons and companies must carry insurance in the event someone has trouble balancing both his/her own weight and/or the weight of any equipment, resulting in a fall and/or injury of the roof worker, the equipment, and/or other people. Insurance adds to the cost of owning a steep-pitched roof or doing business on steep-pitched roofs for persons and companies.

SUMMARY

An apparatus is used over a ridge of a steep-pitched roof, and an embodiment of the apparatus comprises a first portion, a first shoe interconnected to the first portion, a second portion, and a second shoe interconnected to the second portion. An opposite end of the second portion is adjacent an opposite end of the first portion, and the first portion is positioned at an angle relative to the second portion so as to approximate the angle of the ridge of the steep-pitched roof Each of the first portion and the second portion comprises a first member having an end and an opposite end, a second member having an end and an opposite end, and a third member extending between the end of the first member and the end of the second member.

Each of the first shoe and the second shoe comprises an upper pad layer, a foot positioned under the upper pad layer, and a lower pad layer positioned under the foot. The upper pad layer and the lower pad layer can be integrally wrapped around the foot. The lower pad layer of each of the first shoe and the second shoe are in frictional contact with a surface of the steep-pitched roof.

A first leg support can be connected to the end of the first portion and to the first shoe, a second leg support can be connected to the end of the second portion and to the second shoe, a locking member can lock the first portion at the angle relative to the second portion, and an anchor member can be connected to the first portion.

A telescoping mechanism can adjust a length of the first portion and the second portion. The telescoping mechanism can be positioned on the first and second portion to extend the length of the first and second members of each respective portion, or the telescoping mechanism can be positioned between the first member and the third member and between the second member and the third member.

A method anchors a person to a steep-pitched roof using an embodiment of the disclosed apparatus, where the steep-pitched roof has a ridge and a first surface extending from the ridge and a second surface extending from the ridge. An embodiment of the method includes the steps of placing a first shoe interconnected to a first portion of a roof-anchor apparatus on the first surface, and placing a second shoe interconnected to a second portion of the roof-anchor apparatus on the second surface, where the first portion is positioned at an angle relative to the second portion and where the first shoe and the second shoe are at least partially formed of a rubber material.

DETAILED DESCRIPTION

Figure 1:
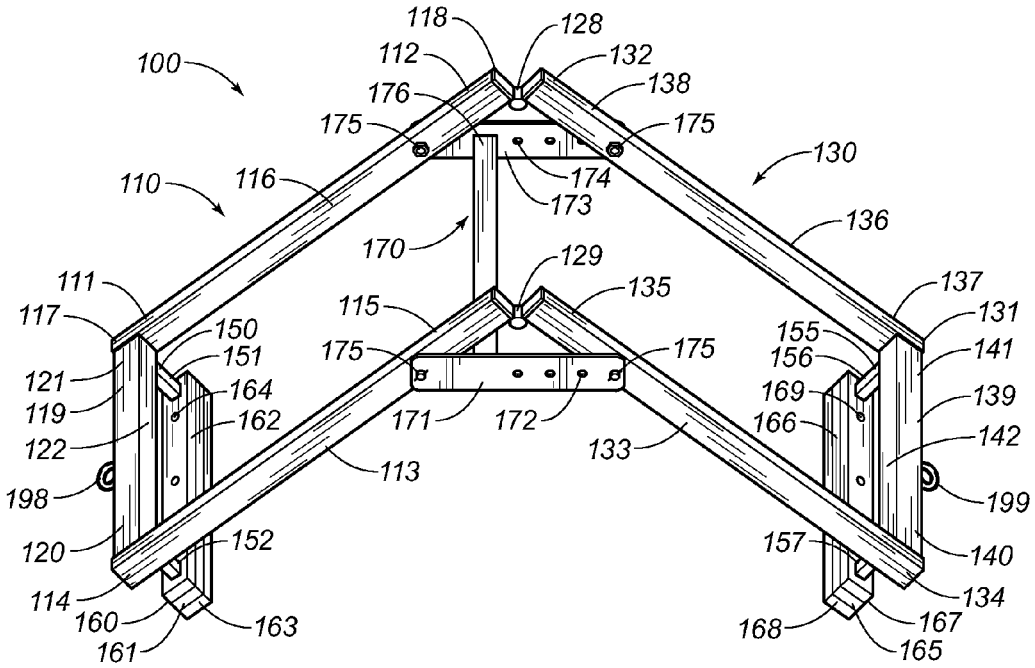
FIG. 1 shows a perspective view of an embodiment of the disclosed apparatus.

The description that follows includes exemplary apparatus and methods that embody the inventive subject matter. While the apparatus and methods are susceptible to various modifications and alternative forms, specific embodiments thereof are shown by way of example in the drawings and will herein be described in detail. All embodiments are preferred.

It should be appreciated that the disclosed apparatus and methods can be utilized by any person on a steep-pitched roof. Persons that can utilize the disclosed apparatus and method can include, but are not limited to, satellite-dish installers, home-owners, roofers, chimney workers, telecommunications personnel, and electricians.

FIG. 1

Referring to FIG. 1, there is shown a perspective view of an embodiment of the disclosed apparatus 100. The apparatus 100 has a first portion 110 that has an end 111 and an opposite end 112, a first shoe 160 interconnected to the end 111 of the first portion 110, a second portion 130 having an end 131 and an opposite end 132, and a second shoe 165 interconnected to the end 131 of the second portion 130. The opposite end 132 of the second portion 130 is positioned adjacent the opposite end 112 of the first portion 110. The apparatus 100 also has a first leg support 150 connected to the end 111 of the first portion 110 and to the first shoe 160, and a second leg support 155 connected to the end 131 of the second portion 130 and to the second shoe 165. In FIG. 1, the first shoe 160 is interconnected to the first portion 110 by first leg support 150 and the second shoe 165 is interconnected to the second portion 130 by second leg support 155; however, it should be appreciated that the first shoe 160 can be directly connected to the first portion 110 and the second shoe 165 can be directly connected to the second portion 130.

In FIG. 1, the first portion 110 is pivotally connected to the second portion 130 with hinges 128 and 129. The hinges 128 and 129 allow the first portion 110 of the apparatus 100 to be positioned at many angles relative to the second portion 130 of the apparatus 100. Alternatively, it should be appreciated that the first portion 110 can be connected to the second portion 130 by a weld or other like means of connecting the portions 110 and 130. In this alternative scenario, the apparatus 100 would be useful for only one angle, and another apparatus 100 having a different angle between the first portion 110 and the second portion 130 would be needed for a steep-pitched roof having a different angle.

An anchor member 198 can be connected to the first portion 110, and an anchor member 199 is connected to the second portion 130. The anchor members 198 and 199 allow a person working on a steep-pitched roof to "tie-off" to the apparatus 100. Placing anchor member 198 on the first portion 110 and anchor member 199 on the second portion 130 allow a person to tie-off to the apparatus 100 on either of the two surfaces extending from the ridge of a roof without changing the position of the apparatus 100. In FIG. 1, the anchor members 198 and 199 are eye-shaped pieces. To tie-off, a person can connect a rope, chain, wire, cord, cable or the like to himself/herself and to one of the anchor members 198 and 199 that is closest to the person. If the person falls or slips on a steep-pitched roof, the rope, chain, wire, cord, cable, or the like pulls tight against the anchor member 198 or 199 because the apparatus 100 holds firmly against the surfaces of the roof and anchors the installer to the roof A locking member 170 locks the first portion 110 at the angle relative to the second portion 130. The locking member 170 has a first side plate 171, a second side plate 173, and a cross bar 176. The cross bar 176 is connected to the first side plate 171 and to the second side plate 173. The first side plate 171 and the second side plate 173 are connected to the opposite end 112 of the first portion 110. The first side plate 171 and the second side plate 173 are also connected to the opposite end 132 of the second portion 130. Pins 175 connect the first plate 171 and the second plate 173 to the opposite end 132 of the second portion 130 of the apparatus 100. The first plate 171 and the second plate 173 of the locking member 170 each have holes 174 formed therein, and the pins 175 are inserted into the appropriate holes 174 so that the first portion 110 of the apparatus 100 extends at an angle relative to the second portion 130. The first and second side plates 171 and 173 can be connected to the first portion 110 with a permanent pivoting connection, a releasably attached pivoting connection, a releasably attached connection, and the like. In FIG. 1, the first plate 171 and the second plate 173 are connected to the opposite end 112 of the first portion 110 with pins 175; thus, the connection shown in FIG. 1 is a releasably attached connection.

The first shoe 160 has an upper pad layer 162, a foot 161 positioned under the upper pad layer 162, and a lower pad layer 163 positioned under the foot 161. The upper pad layer 162 and the lower pad layer 163 can be integrally wrapped around the foot 161. The second shoe 165 can be similar to the first shoe 160. The second shoe 165 has an upper pad layer 167, a foot 166 positioned under the upper pad layer 167, and a lower pad layer 168 positioned under the foot 166. The foot 161 of the first shoe 160 is connected to the first leg support 150 so that the first leg support 150 is positioned between the first shoe 160 and the first portion 110. Likewise, the foot 166 of the second shoe 165 is connected to the second leg support 155 so that the second leg support 155 is positioned between the second shoe 165 and the second portion 130. The first leg support 150 can extend perpendicular to the first portion 110, and the second leg support 155 can extend perpendicular to the second portion 130. The upper pad layer 167 and the lower pad layer 168 can be integrally wrapped around the foot 166. In FIG. 1, the layers 162, 163 and foot 161 of the first shoe 160 are held together by bolts 164. Likewise, the layers 167, 168 and foot 166 of the second shoe 165 are held together by bolts 169. It should be appreciated the shoes 160 and 165 can be held together by other means known to one skilled in the art.

The first portion 110 has a first member 113 having an end 114 and an opposite end 115. A second member 116 of the first portion 110 extends in spaced parallel relationship with the first member 113. The second member 116 has an end 117 and an opposite end 118. A third member 119 extends between the end 114 of the first member 113 and the end 117 of the second member 116. The third member 119 is connected to the first member 113 and to the second member 116. The third member 119 of the first portion 110 interconnects or connects to the first shoe 160. The configuration of the first member 113, second member 116, and third member 119 forms a rectangular shape, and it should be appreciated the members 113, 116, and 119 of the first portion 110 can also form other shapes such as a triangle or trapezoid. In FIG. 1, the members 113, 116, and 119 are formed of a tubular metal, and the connections between the members 113, 116, and 119 are welded.

The second portion 130 has a first member 133 having an end 134 and an opposite end 135. A second member 136 of the second portion 130 can extend in spaced parallel relationship with the first member 133. The second member 136 has an end 137 and an opposite end 138. A third member 139 extends between the end 134 of the first member 133 and the end 137 of the second member 136. The third member 139 is connected to the first member 133 and to the second member 136. The third member 139 of the second portion 130 interconnects or connects to the second shoe 165. The configuration of the first member 133, second member 136, and third member 139 form a rectangular shape, and it should be appreciated the members 133, 136, and 139 of the second portion 130 can also form other shapes such as a triangle or trapezoid. In FIG. 1, the members 133, 136, and 139 are formed of a tubular metal, and the connections between the members 133, 136, and 139 are welded.

In FIG. 1, the first leg support 150 has a first leg 151 and a second leg 152. The first leg 151 is connected to opposite end 121 of the third member 119. The second leg 152 is connected to end 120 of the third member 119. The first leg 151 extends through the upper pad layer 162 of the first shoe 160 and connects to the foot 161 of the first shoe 160. The second leg 152 extends through the upper pad layer 162 of the first shoe 160 and connects to the foot 161 of the first shoe 160.

The second leg support 155 has a first leg 156 and a second leg 157. The first leg 156 is connected to opposite end 141 of the third member 139. The second leg 157 is connected to end 140 of the third member 139. The first leg 156 extends through the upper pad layer 167 of the second shoe 165 and connects to the foot 166 of the second shoe 165. The second leg 157 extends through the upper pad layer 167 of the second shoe 165 and connects to the foot 166 of the second shoe 165.

It should be appreciated that the first and second members 113 and 116 of the first portion 110 can alternatively be interconnected or connected to the first shoe 160 instead of the third member 119. Likewise, it should be appreciated that the first and second members 133 and 136 of the second portion 130 be interconnected or connected to the second shoe 165 instead of the third member 139. Shoes 160 and 165 can interconnect or connect to the ends 111 and 131 of the portions 110 and 130, respectively, because experiments have shown the first shoe 160 and second shoe 165 have a more even and uniform contact with surfaces of a roof. A more even and uniform contact with roof surfaces is desirable because a larger surface area of contact is made between the shoes 160, 165 and the roof. A larger surface area of contact provides more frictional contact, which provides more stability and less movement of the apparatus 100. Thus, the apparatus 100 sits firmly over the ridge of a roof It should be appreciated the first and second members 113, 116 can be connected with the third member 119 where the first and second members 113, 116 extend for the entire length of the first portion 110 and where the third member 119 extends between the first and second members 113 and 116. Alternatively, the third member 119 can extend for the entire width of the first portion 110 where the first and second members 113, 116 do not extend past the ends 120, 121 of the third member 119, respectively. Likewise, it should be appreciated the first and second members 133, 136 can be connected with the third member 139 where the first and second members 133, 136 extend for the entire length of the second portion 130 and where the third member 139 extends between the first and second members 133 and 136. Alternatively, the third member 139 can extend for the entire width of the first portion 130 where the first and second members 133, 136 do not extend past the ends 140, 141 of the third member 139, respectively.

FIG. 1 shows the use of square metal tubing for first and second portions 110 and 130, the first and second leg supports 150 and 155, and the cross bar 176 of the locking member 170. The metal tubing can be approximately 1½" square-steel tubing. The pins 175 can be approximately ⅜" in diameter. The foot 161 and foot 166 can have a length of approximately 21½" and a width of approximately 4". The leg supports 150 and 155 can be made of approximately ½" square steel tubing and can have a length of approximately 3". The anchor members 198 and 199 can be a ½ eye hook. The first and second members 113 and 116 of the first portion 110 and the first and second members 133 and 136 of the second portion 130 can have a length of approximately 24". The third member 119 of the first portion 110 and the third member 139 of the second portion 130 can have a length of approximately 19". The first and second side plates 171 and 173 of the locking member 170 can have a length of approximately 11", a width of approximately 4", and a thickness of approximately 3/16".

The upper pad layers 162 and 167 and lower pad layers 163 and 168 can be formed of a compressible and form-fitting polymer with a high wear-resistance, such as a rubber. The material of the lower pad layers 163 and 168 can have a melting point higher than the hottest temperatures a roof can reach when exposed to the sun. For example, some roofs are known to reach 130.degrees.F in the sun; thus, the material of the lower pad layers 163 and 168 should have a melting point higher than 130.degrees.F. Also, material of the lower pad layers 163 and 168 can have a low stiffness at low temperatures when roof shingles can be brittle. The stiffness at low temperatures should be less than a stiffness of metal at low temperatures.

The apparatus 100 is extremely stable while using only a few efficient points of contact (shoes 160 and 165) with the surfaces extending from a ridge of a roof. The shoes 160 and 165 frictionally contact roof surfaces, and the material of the shoes 160 and 165 holds against the roof surfaces even at low and high temperatures without damaging or compromising the integrity of the roof surfaces. Thus, the apparatus 100 simultaneously provides a stable anchor for installers of satellite dishes while contacting the roof with shoes 160 and 165 configured to hold against roof surfaces without damaging or compromising the integrity of the roof surfaces.

FIG. 2

Figure 2:
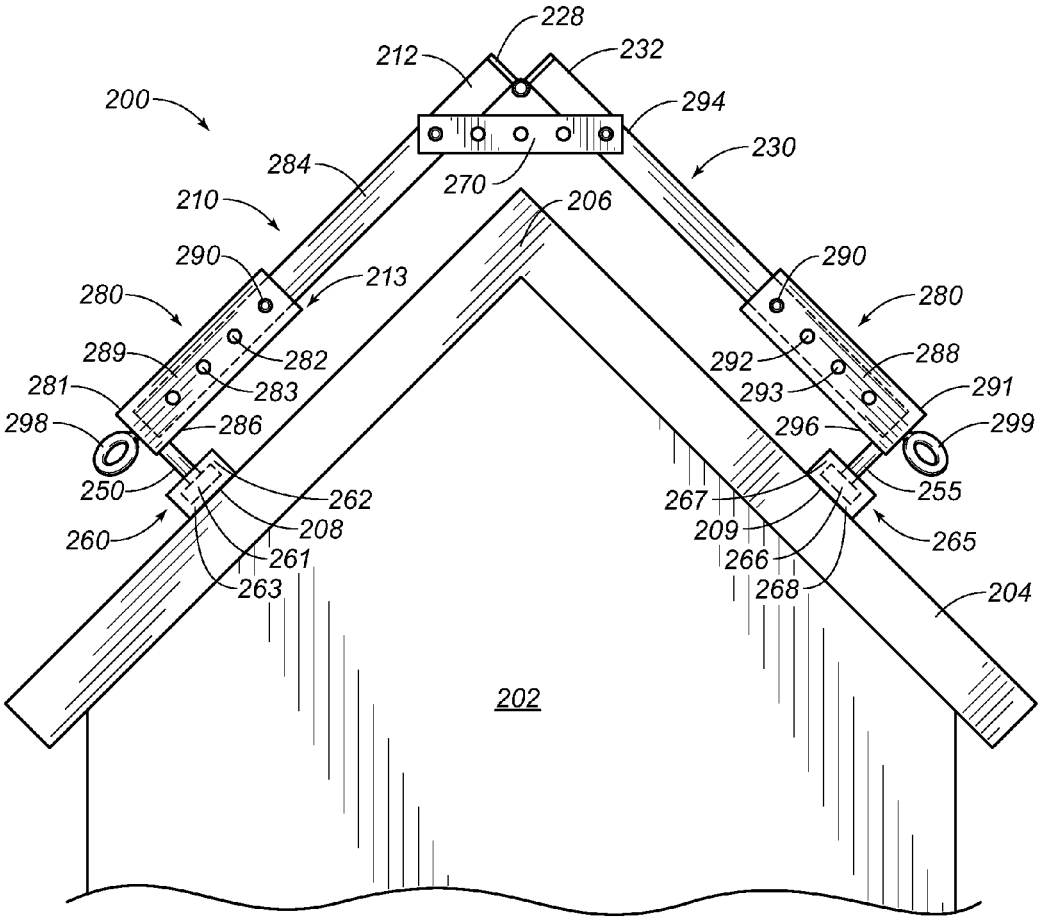
FIG. 2 shows a side-elevational view of another embodiment of the disclosed apparatus, as used on a steep-pitched roof and having a telescoping mechanism.

Referring to FIG. 2, there is shown a side elevational view of another embodiment of the disclosed apparatus 200, as used on a steep-pitched roof 204 and having a telescoping mechanism 280. As can be seen, the apparatus 200 is used over a ridge 206 of a steep-pitched roof 204. The ridge 206 can be any ridge on a step-pitched roof and not only the highest point of the roof. The first portion 210 is positioned at an angle relative to the second portion 230 so as to approximate the angle of the ridge 206 of the steep-pitched roof. The angle between the first portion 210 and the second portion 230 of the apparatus 200 can be the same as the angle between the surfaces 208 and 209 of the roof 204. When the angles are the same, the first portion 210 extends parallel to surface 208 of roof 204, and the second portion 230 extends parallel to surface 209 of roof 204, creating an even distribution of forces in the first and second shoes 260 and 265, and thus an even contact pressure of the shoes 260 and 265 against the surfaces 208 and 209, respectively.

The first shoe 260 contacts the surface 208 of the roof 204, and the second shoe 265 contacts the surface 209 of the roof 204. Particularly, the lower pad layer 263 of the first shoe 260 is in frictional contact with surface 208 of the steep-pitched roof 204, and the lower pad layer 268 is in frictional contact with surface 209 of the steep-pitched roof 204. The roof 204 is not damaged or compromised by the apparatus 200 because only the first and second shoes 260 and 265 of the apparatus 200 contact the surfaces 208 and 209 of the roof 204, respectively. The first shoe 260 supports the first portion 210 above the surface 208 of the roof 204, and the second shoe 265 supports the second portion 230 above the surface 209 of the roof 204.

The foot 261 of the first shoe 260 is shown with dashed lines to indicate the foot 261 is enclosed be the upper pad layer 262 and the lower pad layer 263 of the first shoe 260. The foot 266 of the second shoe 265 is shown with dashed lines to indicate the foot 265 is enclosed by the upper pad layer 267 and the lower pad layer 268 of the second shoe 265. In FIG. 2, the foot 261 is connected to the first leg support 250 and the foot 266 is connected to the second leg support 255. Thus, the upper pad layer 262 of the first shoe 260 and the upper pad layer 267 of the second shoe 265 wrap around the first leg support 250 and second leg support 255, respectively.

The apparatus 200 in FIG. 2 has a telescoping mechanism 280 positioned on the first portion 210 and the second portion 230. The telescoping mechanism 280 is shown in a retracted position in FIG. 2. A first side 284 of the first member 213 extends within a second side 286 of the first member 213 of the first portion 210. First side 284 has holes 283 formed therein, and second side 286 has holes 282 formed therein. A pin 290 in inserted into one of holes 283 and one of holes 282 to secure the first side 284 of the first member 213 relative to the second side 286 of the first member 213. When telescoping mechanism 280 is in the retracted position, end 281 of the second side 286 is adjacent end 289 of the first side 284. A first side 294 of the first member 233 extends within a second side 296 of the first member 233 of the first portion 230. First side 294 has holes 293 formed therein, and second side 296 has holes 292 formed therein. A pin 290 in inserted into one of holes 293 and one of holes 292 to secure the first side 294 of the first member 233 relative to the second side 296 of the first member 233. When telescoping mechanism 280 is in the retracted position, end 291 of the second side 296 is adjacent end 288 of the first side 294. End 289 of first side 284 is shown with dashed lines. End 288 of first side 294 is shown with dashed lines.

Opposite end 212 of first portion 210 is attached to hinge 228. Opposite end 232 of second portion 230 is attached to hinge 228. The locking member 270 is connected to the opposite end 212 of the first portion 210 and to the opposite end 232 of the second portion 230.

FIG. 3

Figure 3:
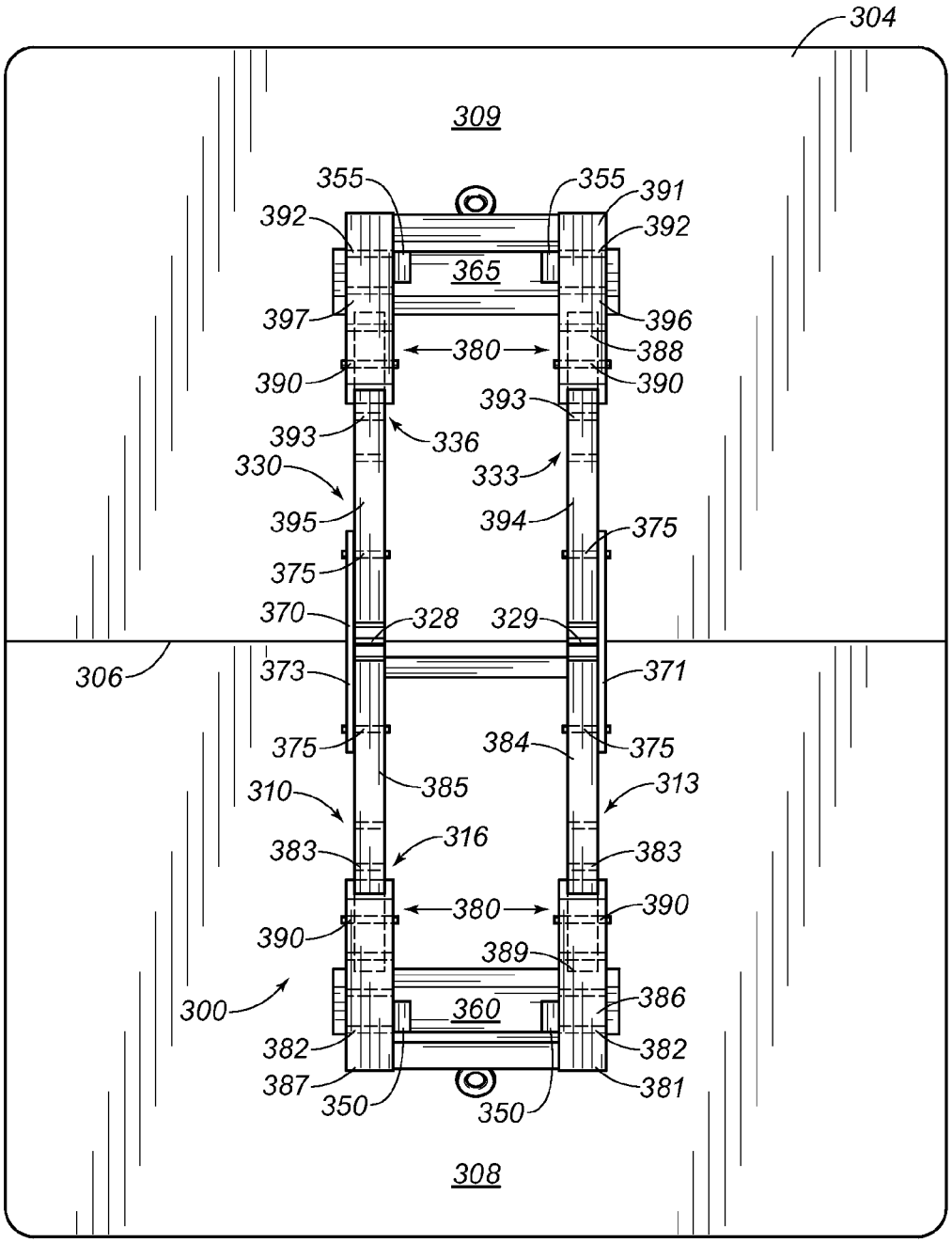
FIG. 3 shows a plan view of the embodiment of the apparatus in FIG. 2, with the telescoping mechanism in an extended position.

Referring to FIG. 3, there is shown a plan view of the embodiment of the apparatus 300 disclosed in FIG. 2, with the telescoping mechanism 380 in an extended position. In the telescoping mechanism 380, the first member 313 of the first portion 310 has a first side 384 and a second side 386, the second member 316 of the first portion 310 has a first side 385 and a second side 387, the first member 333 of the second portion 330 has a first side 394 and a second side 396, and the second member 336 of the second portion 330 has a first side 395 and a second side 397. The telescoping mechanism 380 adjusts the length of the first member 313 of the first portion 310 and the length of the second member 316 of the first portion 310. The telescoping mechanism 380 adjusts the length of the first member 333 of the second portion 330 and the length of the second member 336 of the second portion 330. The telescoping mechanism 380 allows the second sides 386 and 387 to extend further down the surface 308 of the steep-pitched roof 304, adding more stability to the apparatus 300 if it is needed. The telescoping mechanism 380 allows the second sides 396 and 397 to extend further down the surface 309 of the steep-pitched roof 304, adding more stability to the apparatus 300 if it is needed. The apparatus 300 is over a ridge 306 of the steep-pitched roof 304.

When the telescoping mechanism 380 is in the extended position, the end 381 of the second side 386 of the first member 313 of the first portion 310 is separated from the end 389 of the first side 384 of the first member 313 of the first portion 310. When the telescoping mechanism 380 is in the extended position, the end 391 of the second side 396 of the first member 333 of the second portion 330 is separated from the end 388 of the first side 394 of the first member 333 of the second portion 330. Some of holes 383 in the first side 384 are exposed outside the holes 382 of the second side 386 when the telescoping mechanism 380 is in the extended position. Some of holes 383 in the first side 385 are exposed outside the holes 382 of the second side 387 when the telescoping mechanism 380 is in the extended position. Some of holes 393 in the first side 394 are exposed outside the holes 392 of the second side 396 when the telescoping mechanism 380 is in the extended position. Some of holes 393 in the first side 395 are exposed outside the holes 392 of the second side 397 when the telescoping mechanism 380 is in the extended position.

The side plates 371 and 373 of the locking member 370 can be seen as connected outside of the first and second members 313 and 316 of the first portion 310 and the first and second members 333 and 336 of the second portion 330, but the side plates 371 and 373 can be placed inside members 313, 316, 333, 336. Pins 375 can be seen as extending through the locking member 370 and the first and second portions 310 and 330. Hinges 328 and 329 connect the first portion 310 and the second portion 330. The first leg support 350 connects the first portion 310 to the first shoe 360, and the second leg support 355 connects the second portion 330 to the second shoe 365.

To extend the telescoping mechanism 380 from the retracted position in FIG. 2 to the extended position in FIG. 3, pins 290 are removed from the telescoping mechanism 280, the lengths of the first portion 210 and second portion 230 are extended to a length such as that shown in FIG. 3, and pins 390 are inserted into the telescoping mechanism 380. While extending the length of the first portion 210, the lengths of the first member 213 and second member 216 are extended, and the first shoe 260 is moved from the position shown in FIG. 2 to the position of the first shoe 360 shown in FIG. 3. The adjusted lengths of the first member 313 and second member 316 are shown in FIG. 3. It should be appreciated that the first shoe 360 can be connected or interconnected to the third member 319 or the second sides 386 and 387 of the first and second members 313 and 316 when telescoping mechanism 380 is included with apparatus 300. While extending the length of the second portion 230, the lengths of the first member 233 and second member 236 are extended, and the second shoe 265 is moved from the position shown in FIG. 2 to the position of the second shoe 365 shown in FIG. 3. The adjusted lengths of the first member 333 and second member 336 are shown in FIG. 3. It should be appreciated that the second shoe 365 can be connected or interconnected to the third member 339 or the second sides 396 and 397 of the first and second members 333 and 336 when telescoping mechanism 380 is included with apparatus 300.

FIG. 4

Figure 4:
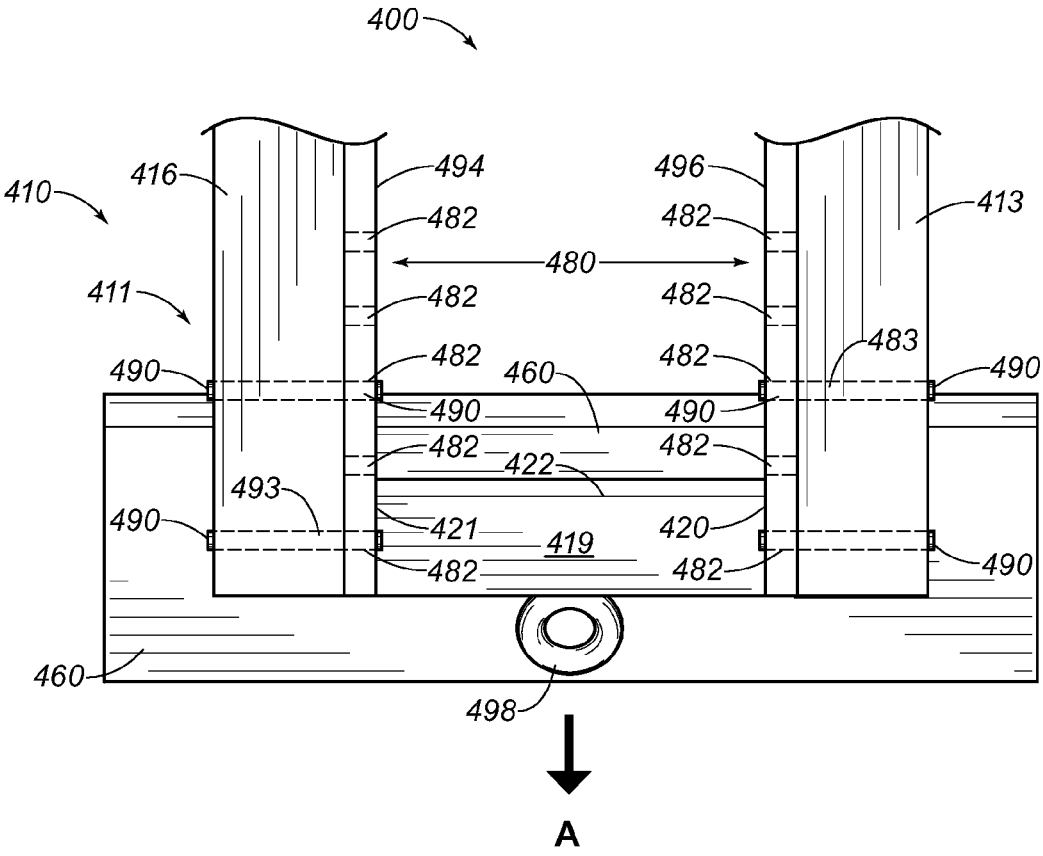
FIG. 4 shows an isolated plan view of a portion of the disclosed apparatus, with the portion having another embodiment of the telescoping mechanism.

FIG. 4 shows an isolated plan view of a portion 410 of the disclosed apparatus 400, with the portion 410 having another embodiment of the telescoping mechanism 480. The portion 410 can be either the first portion or the second portion discussed in FIGS. 1 to 3 above because the portions, as discussed for the embodiment shown in FIG. 4, are substantially identical. The telescoping mechanism 480 is positioned between the first member 413 and the third member 419 and between the second member 416 and the third member 419 of the portion 410. Positioning member 494 of the telescoping mechanism 480 is between the second member 416 and the third member 419 of the first portion 410. Position member 496 of the telescoping mechanism 480 is between the first member 413 and the third member 419 of the first portion 410.

The telescoping mechanism 480 has holes 482 formed therein. Two pins 490 are inserted through holes 483 in the first member 413 and through holes 482 of the positioning member 496 of the telescoping mechanism 480. Two pins 490 are inserted through holes 493 of the second member 416 and through holes 482 of positioning member 494 of telescoping mechanism 480.

In the telescoping mechanism 480 shown in FIG. 4, the positioning members 494 and 496 are slidable relative to the first member 413 and the second member 416 of the portion 410. The positioning members 494 and 496 are connected to the ends 421 and 420 of the third member 419, respectively.

The positioning members 494 and 496 can be welded to the ends 421 and 420 of the third member 419, respectively. It should be appreciated the positioning members 494 and 496 can be connected to the front 422 of the third member 419 adjacent the ends 421 and 420, respectively. It should be appreciated that the positioning members 494 and 496 can also be connected to the first and second members 413 and 416 while being slidable relative to the third member 419, and in this scenario, the pins 490 would have a cross-sectional shape that would prevent rotation of the third member 419 relative to the first and second members 413 and 416, such as a square or triangle and should be a shape with less than nine sides.

The telescoping mechanism 480 can be extended by removing pins 490 and sliding the positioning members 413 and 416 in the direction of arrow A relative to the first member 413 and second member 416 of the portion 410 of apparatus 400. Because the shoe 460 is interconnected or connected to the third member 419, the shoe 460 moves along with the third member 419 as the positioning members 494 and 496 are extended relative to the first and second members 413 and 416. When the positioning members 494 and 496 are extended to an appropriate length so as to adjust the length of the portion 410, holes 482 of the positioning members 494 and 496 are aligned with holes 483 of the first member 413 and holes 493 of the second member 416. The pins 490 are then again inserted through the aligned holes 483 and 482 and aligned holes 482 and 493. The pins 490 have means for locking the pins 490 in place once the pins 490 are inserted into the holes 482, 483, and 493.

Method

The apparatus 200 can be called a roof-anchor apparatus. To anchor a person (i.e. an installer of satellite dishes) to the steep-pitched roof 204, the roof-anchor apparatus 200 is placed over the ridge 206, the first shoe 260 is placed on the first surface 208 extending from the ridge 206, and the second shoe 265 is placed on the second surface 209 extending from the ridge 206. The locking mechanism 270 can be set to lock the first portion 210 at an angle relative to the second portion 230, and at an angle approximate to the angle between the first surface 208 of the roof 204 and the second surface 209 of the roof 204. The person can then tie-off a rope or the like to the anchor member 298 connected to the first portion 210 of the roof-anchor apparatus 200 when the person is on the first surface 208 of the steep-pitched roof 204. The person can then tie-off a rope or the like to the anchor member 299 connected to the second portion 230 of the roof-anchor apparatus 200 when the person is on the second surface 209 of the steep-pitched roof 204. To telescope the roof-anchor apparatus 200, the first portion 210 and second portion 230 are telescoped so as to increase the length of the first portion 210 and the length of the second portion 230. The first shoe 260 moves down the first surface 208 of the steep-pitched roof 204 when the first portion 210 is telescoped, and the second shoe 265 moves down the second surface 209 of the steep-pitched roof 204 when the second portion 230 is telescoped. The telescoping can occur before or after the first and second shoes 260 and 265 are positioned on the first and second surfaces 208 and 209, respectively, of the roof 204. If the telescoping occurs after the first and second shoes 260 and 265 are positioned on the roof 204, the first and second shoes 260 and 265 are then re-positioned on the first and second surfaces 208 and 209 of the roof 204.

It should be understood that the drawings and specification are not intended to limit the embodiments to the particular form(s) disclosed. It is intended that the disclosure shall cover all modifications, equivalents and alternatives falling within the spirit and scope of the following claims.

We claim:

1. A roof-anchor apparatus for use over a ridge of a steep-pitched roof comprising:

a first portion having an end and an opposite end, wherein the first portion consists of:

a first member having an end and an opposite end;

a second member having an end and an opposite end; and a third member extending between the end of the first member of the first portion and the end of the second member of the first potion;

a first shoe interconnected to the end of the first portion via the third member of the first portion, wherein the first shoe is configured to hold the apparatus against the steep-pitched roof via frictional contact;

a second portion having an end and an opposite end, the opposite end of the second portion positioned adjacent the opposite end of the first portion, the first portion being positioned at an angle relative to the second portion so as to approximate the angle of the ridge of the steep pitched roof, wherein the second portion consists of:

a first member having an end an opposite end;

second member having an end and an opposite end; and a third member extending between the end of the first member of the second portion and the end of the second member of the second portion;

a second shoe interconnected to the end of the second portion via the third member of the second portion, wherein the second shoe is configured to hold the apparatus against the steep-pitch roof via frictional contact; and a locking member for adjustably locking the first portion at an angle relative to the second portion, wherein the locking member comprises:

a first plate connected to the first member of the first portion and to the first member of the second portion;

a second plate connected to the second member of the first portion and to the second member of the second portion; and a cross bar extending between and connected to the first plate and to the second plate.

2. The apparatus of claim 1, wherein the first plate of the locking member is connected to the opposite end of the first portion;

wherein the second plate of the locking member is connected to the opposite end of the first portion.

3. The apparatus of claim 1, further comprising:

a first leg support positioned between the first shoe and the first portion, wherein the first leg support is connected to the end of the first portion and to the first shoe; and a second leg support positioned between the second shoe and the second portion, wherein the second leg support is connected to the end of the second portion and to the second shoe.

4. The apparatus of claim 3, the first leg support extending perpendicular to the first portion, the second leg support extending perpendicular to the second portion.

5. The apparatus of claim 1, each of the first shoe and the second shoe comprising:

an upper pad layer;

a foot positioned under the upper pad layer; and a lower pad layer positioned under the foot, wherein the lower pad layer is in frictional contact with the steep-pitched roof.

6. The apparatus of claim 5, the upper pad layer and the lower pad layer being integrally wrapped around the foot,

7. The apparatus of claim 5, the lower pad layer of each of the first shoe and the second shoe being in frictional contact with a surface of the steep-pitched roof, the first shoe supporting the first portion above the surface of the steep-pitched roof, the second shoe supporting the second portion above the surface of the steep-pitched roof

8. The apparatus of claim 7, the first portion being parallel to the surface of the roof, the second portion being parallel to the surface of the roof.

9. The apparatus of claim 5, the foot of the first shoe being connected to a first leg support, the first leg support positioned between the foot of the first shoe and the first portion, the foot of the second shoe being connected to a second leg support, the second leg support positioned between the foot of the second shoe and the second portion.

10. The apparatus of claim 1, wherein the first member of the first portion is parallel to the second member of the first portion, wherein the third member of the first portion is interconnected to the first shoe, wherein the first member of the second portion is parallel to the second member of the second portion, wherein the third member of the portion is interconnected to the second shoe.

11. The apparatus of claim 1, further comprising:

a telescoping mechanism positioned on the first portion.

12. The apparatus of claim 11, further comprising a second telescoping mechanism positioned on the second portion.

13. The apparatus of claim 12, the telescoping mechanism for adjusting a length of a first member of the first portion and a length of a second member of the first portion, the second telescoping mechanism for adjusting as length of a first member of the second portion and a length of as second member of the second portion.

14. The apparatus of claim 12, the second portion having the first member positioned parallel to the second member, the second telescoping mechanism positioned between the first member and the third member and between the second member and the third member.

15. The apparatus of claim 11, the first portion having the first member positioned parallel to the second member, the telescoping mechanism positioned between the first member and the third member and between the second member and the third member.

16. The apparatus of claim 1, further comprising:

an anchor member connected to the first portion.

17. The apparatus of claim 1, wherein the first portion has a length of approximately 24", wherein the second portion has a length of approximately 24", wherein the first shoe comprises a foot, wherein the foot of the first shoe has a length of approximately 21½", wherein the second shoe comprises a foot, wherein the foot of the second shoe has a length of approximately 21½".

18. The apparatus of claim 1, wherein the first shoe and the second shoe are the only points of contact of the apparatus with the steep-pitched roof.

19. A roof-anchor apparatus for use over a ridge of a steep-pitch roof comprising:

a first portion having an end and an opposite end, wherein the first portion comprises:

a first member having an end and an opposite end;

a second member having an end and an opposite end;

a third member extending between the end of the first member of the first portion and the end of the second member of the first portion;

a first shoe interconnected to the end of the first portion via the third member of the first portion, wherein the first shoe is configured to hold the apparatus against the steep-pitch roof via friction contact;

a second portion having an end and an opposite end, the opposite end of the second portion positioned adjacent the opposite end of the first portion, the first portion being positioned at an angle relative to the second potion so as to approximate the angle of the ridge of the steep pitched roof, wherein the second portion comprises;

a first member having an end and an opposite end;

a second member having an end and an opposite end; and a third member extending between the end of the first member of the second portion and the end of the second member of the second portion;

a second shoe interconnected to the end of the second portion via the third member of the second portion, wherein the second shoe is configured to hold the apparatus against the steep-pitched roof via friction contact; and a locking member for adjustably locking the first portion at an angle relative to the second portion, wherein the locking member comprises;

a first plate connected to the first member of the first portion and to the first member of the second portion;

a second plate connected to the second member of the first portion and to the second member of the second portion; and a cross bar extending between and connected to the first plate and to the second plate;

wherein the first portion and the second portion have no rungs.

* * * * *

UNITED STATES PATENT AND TRADEMARK OFFICE

CERTIFICATE OF CORRECTION

PATENT NO. : 8,636,108 B2
APPLICATION NO. : 12/911730
DATED : January 28, 2014
INVENTOR(S) : Odes Foster, Sr. and Odes Foster, Jr.

It is certified that error appears in the above-identified patent and that said Letters Patent is hereby corrected as shown below:

In the Specification

In Column 11, Line 27, replace "the portion" with --the first portion--.

Signed and Sealed this
Eighth Day of April, 2014

Michelle K. Lee

Michelle K. Lee
*Deputy Director of the United States Patent and Trademark Office*